United States Patent [19]

Burns et al.

[11] Patent Number: 4,526,001

[45] Date of Patent: Jul. 2, 1985

[54] METHOD AND MEANS FOR CONTROLLING AIR-TO-FUEL RATIO

[75] Inventors: Kenneth R. Burns, Westfield; Jack J. Early, Perth Amboy, both of N.J.

[73] Assignee: Engelhard Corporation, Iselin, N.J.

[21] Appl. No.: 433,199

[22] Filed: Oct. 7, 1982

Related U.S. Application Data

[63] Continuation of Ser. No. 235,071, Feb. 13, 1981, abandoned.

[51] Int. Cl.[3] ..... F01N 3/20; F02B 33/00

[52] U.S. Cl. ..... 60/274; 60/276; 60/285; 123/440; 123/489; 123/589

[58] Field of Search ..... 60/276, 285, 274; 123/440, 489, 589; 431/12, 76, 268

[56] References Cited

U.S. PATENT DOCUMENTS

| | | | |
|---|---|---|---|
| 3,354,931 | 11/1967 | Risse | 431/76 |
| 3,782,347 | 1/1974 | Schmidt | 60/276 |
| 4,024,706 | 5/1977 | Adawi | 60/274 |
| 4,088,095 | 5/1978 | Aono | 123/440 |
| 4,099,491 | 7/1978 | Reddy | 60/276 |
| 4,112,880 | 9/1978 | Asano | 60/276 |
| 4,143,623 | 3/1979 | Norimatsu | 60/276 |
| 4,169,440 | 10/1979 | Taplin | 60/276 |
| 4,202,301 | 5/1980 | Early | 123/489 |
| 4,377,143 | 3/1983 | Hamburg | 123/440 |

*Primary Examiner*—Douglas Hart

[57] ABSTRACT

A method for controlling the air-to-fuel ratio fed to an engine or other combustion device provides for periodically adjusting the air-to-fuel ratio to stoichiometric or near stoichiometric, within the response range of the conventional exhaust gas sensor employed. This establishes a reference point from which the setting of an air-to-fuel ratio proportioning device (e.g., carburetor) is established by moving its adjustment means a selected distance from its setting at the reference point. The selected value may be outside the normal response range of the sensor, either rich or lean of stoichiometric. The apparatus may include a sensor which generates an output signal which is compared against a reference signal by a comparator. When the output signal exceeds (or falls below) the reference signal, a timer to operate the proportioning device adjustment means in the desired direction for a stated interval of time is actuated. A separate timer operates the adjustment means towards stoichiometric at selected intervals to periodically establish the reference point.

24 Claims, 6 Drawing Figures

PLOT OF PRIOR ART CONTROLLER OPERATION

METHOD AND MEANS FOR CONTROLLING AIR-TO-FUEL RATIO

This is a continuation of application Ser. No. 06/235,071, filed Feb. 13, 1981, now abandoned.

BACKGROUND OF THE INVENTION

The present invention relates to a means and method for controlling the air-to-fuel ratio of a combustible mixture fed to a combustion device. The invention is broadly applicable to such purpose and is specifically useful in adjusting the air-to-fuel ratio of the combustible mixture fed to an internal combustion engine or to a catalytic combustor.

The prior art is replete with schemes for controlling air-to-fuel ratios, in particular for controlling the air-to-fuel ratio of the combustible mixture fed to an internal combustion engine. Often, the purpose of controlling the air-to-fuel ratio is to enhance the operation of a catalytic exhaust gas purification device while maintaining acceptable levels of engine performance and efficiency. U.S. Pat. No. 4,202,301, assigned to the assignee of this application, discloses an air-to-fuel ratio control mechanism which operates in partial response to a control circuit which, in turn, is responsive to the output of an oxygen sensor mounted in the exhaust line of the engine. This type of arrangement is well-known in the art, and is often referred to as a "closed-loop" operation in which the carburetor or other air-fuel metering device is regulated by a control means which receives, as an input to it, a signal corresponding to the presence of oxygen in the engine exhaust gas, as sensed by the sensor.

U.S. Pat. No. 4,019,474 discloses apparatus which comprises a detector for detecting the density of one component, for example oxygen, in the exhaust gases from an internal combustion engine for the purpose of regulating the air-to-fuel ratio. The regulation is based on the detected value of the component in such a manner that the air-to-fuel ratio approximates the theoretically correct air-to-fuel ratio, i.e., the stoichiometric ratio.

U.S. Patent 3,986,352 discloses a fuel control for an engine equipped with a catalytic convertor which engine is normally operated "closed-loop" with a feedback signal from an air-fuel ratio sensor in the engine exhaust. As illustrated in the figure of the patent, an exhaust gas sensor produces an output voltage which exhibits a great rate of change in response to composition changes when operation is in the vicinity of the stoichiometric air-fuel ratio. The signal generated by the sensor passes through a control unit and ultimately influences the air-fuel ratio control means of a carburetor. A relatively inexpensive and commercially available zirconia-type oxygen sensor displays this characteristic of showing, in the vicinity of a stoichiometric air-to-fuel ratio, a large change in the voltage of the output signal with change in the air-to-fuel ratio. However, its sensitivity to change in the air-to-fuel ratio diminishes rapidly as the air-to-fuel ratio moves away from stoichiometric, either to the lean or the rich side. For this reason, if it is desired to run either rich or lean a significant distance away from stoichiometric it is not feasible, with a zirconia type oxygen sensor, to control the air-to-fuel ratio at a selected value differing significantly from stoichiometric.

This inherent limitation of oxygen (or other gas component) sensors is not a problem with conventional internal combustion engines, such as automobile engines, which are equipped with the so-called three-way conversion catalysts utilized to purify the exhaust gas. Three-way conversion catalysts of the type disclosed in U.S. Pat. No. 4,157,316, assigned to the assignee of this application, are typically used to treat exhaust gases by substantially simultaneously oxidizing carbon monoxide and unburned hydrocarbons and reducing nitrogen oxides to nitrogen. For most efficient operation of these catalysts, the engine should be operated at or very close to stoichiometric air-to-fuel conditions. Accordingly, a conventional zirconia or other sensor is useful since it is sensitive to changes in the air-fuel ratio range about stoichiometric conditions. Accordingly, the reference signal generated by the sensor can be utilized to make adjustments to the air-to-fuel ratio control of the carburetor or fuel injection device so as to hold operation at or very close to stoichiometric.

However, for certain applications, it is desired to run either on the rich or on the lean side of stoichiometric at an air-to-fuel ratio which is outside the sensitivity or response range of available oxygen or other gas component sensors. For example, it is believed that fuel economy can be increased or maximized under lean air-to-fuel ratio conditions, generally about 1 to 3 air-to-fuel ratios lean of stoichiometric. Operation in this range would preclude the use of a closed loop system using an exhaust gas sensor which is sensitive only within a limited range about stoichiometric. In certain other applications it is desirable to operate on the rich side of stoichiometric, outside the response range of conventional sensors. For example, natural gas fueled internal combustion engines such as the type utilized in pipelines and oil fields, require maintenance of a rich A/F ratio which lies outside the limited range of available, reasonable cost sensors.

While means exist for determining exhaust gas component concentration levels resulting from air-to-fuel ratios which lie outside the conventional sensor response range, such equipment is either very expensive, complicated or delicate, or all three, as compared to sensors of the type described above, and therefore are not practical for utilization in most internal combustion engine or catalytic combustor applications. Whether used in a motor vehicle or in stationary equipment, such as a stationary internal combustion engine or a catalytic combustor, it would be desirable to be able to use the less expensive and relatively rugged sensor in lieu of more complicated, delicate and/or expensive sensors or analytical equipment.

It is accordingly an object of the present invention to provide a method and means for controlling the air-to-fuel ratio at a selected value or values which may, but not necessarily are, outside the responsiveness range of the conventional oxygen or other gas component sensor, while nevertheless employing such a sensor as the exhaust gas sensing means.

It is a further object of the present invention to provide a method and means utilizing an exhaust gas component sensor for controlling the air-to-fuel ratio fed to a combustion device, such as an internal combustion engine or a catalytic combustor, without necessity of rapidly oscillating between rich and lean operation.

It is a further object of the present invention to utilize the signal generated from a conventional oxygen (or other gas component) sensor to operate a combustion device, eg., a natural gas fuel engine, at an air-to-fuel ratio displaced from stoichiometric; eg., rich of stoichiometric, while reducing to a minimum or substantially eliminating "wrong side", eg., to lean of stoichiometric, excursions.

Yet another object of the present invention is to provide a control system which operates "open loop" for a proportion of operating time, i.e., without continuous adjustment of the air-to-fuel ratio.

Other objects and advantages of the invention will become apparent from the following description.

SUMMARY OF THE INVENTION

In accordance with the present invention there is provided the combination of an air-to-fuel ratio control system and a fuel burning mechanism, the fuel burning mechanism having an adjustable air-fuel proportioning device, a combustion chamber and an exhaust conduit serially interconnected in flow communication whereby a selectively proportioned air-fuel mixture may be introduced from the proportioning device into the combustion chamber for combustion therein, and exhaust gases may be withdrawn therefrom through the exhaust conduit. The air-to-fuel ratio control system comprises sensor means positioned in the exhaust gas conduit and having a limited range of response to the level of a gaseous component in the exhaust gas to produce a reference signal corresponding to the level. Reset means are operatively connected to the air-fuel proportioning device for periodically adjusting the air-to-fuel ratio to a first value selected so as to result in a level of the component in the exhaust gas, which level lies within the response range of the sensor, thereby periodically triggering a reference signal generated by the sensor means.

Positioning means are operatively connected to the proportioning device and are responsive to the reference signal to adjust the air-to-fuel ratio to a second value which deviates from the first value by a selected amount and which may, but does not necessarily, result in a level of the component in the exhaust gas lying outside the response range, whereby the air-to-fuel ratio is periodically adjusted to the second value. The positioning means may be configured to adjust the air-to-fuel ratio to either rich or lean of stoichiometric.

In one aspect of the invention, the sensor means may be an oxygen sensor means, such as a zirconia sensor, responsive to a range of oxygen level in the exhaust gas corresponding to operation about the stoichiometric air-to-fuel ratio and, the positioning means may be adjustable to enable selection of the amount of deviation from the first selected value which is imposed on the air-fuel metering means by the positioning means.

In other aspects of the invention, the fuel burning mechanism may comprise a catalytic combustor or an internal combustion engine and, in the latter case, an exhaust gas purification catalyst may be positioned in the exhaust conduit downstream of the sensor means.

In accordance with another aspect of the invention, there is provided a method for controlling the air-to-fuel ratio of a fuel burning mechanism by utilizing the sensed level of a component in the exhaust gas which permits maintenance of the ratio at values which result in exhaust gas levels of the component outside the response range of sensor means employed to sense the component level, the combustion mechanism is one having an adjustable air-fuel proportioning device, a combustion chamber and an exhaust conduit serially interconnected in flow communication whereby a selectively proportioned air-fuel mixture may be introduced from said proportioning device into said combustion chamber for combustion therein, and exhaust gases may be withdrawn therefrom through the exhaust conduit. The method comprises the following steps. Periodically, the air-to-fuel ratio is adjusted to a first value selected to result in a level of said component in the exhaust gas which lies within the response range of sensor, thereby periodically triggering a response range-reference signal generated by the sensor. The air-to-fuel ratio is adjusted in response to the reference signal in a direction opposite to that employed to attain the first value and in an amount to attain a second value of the air-to-fuel ratio which deviates from the first value by a selected amount and which results in a level of the component in the exhaust gas which is outside the sensor response range. As a result, the air-to-fuel ratio is periodically adjusted to the second value in response to the periodic triggering of the reference signal.

In one embodiment the air-to-fuel ratio is adjusted in the lean direction to attain the first value and is adjusted in the rich direction to attain said second value; in another embodiment the air-to-fuel ratio is adjusted in the rich direction to attain the first value is adjusted in the lean direction to attain the second value.

DESCRIPTION OF THE PREFERRED EMBODIMENTS

Figure 1:
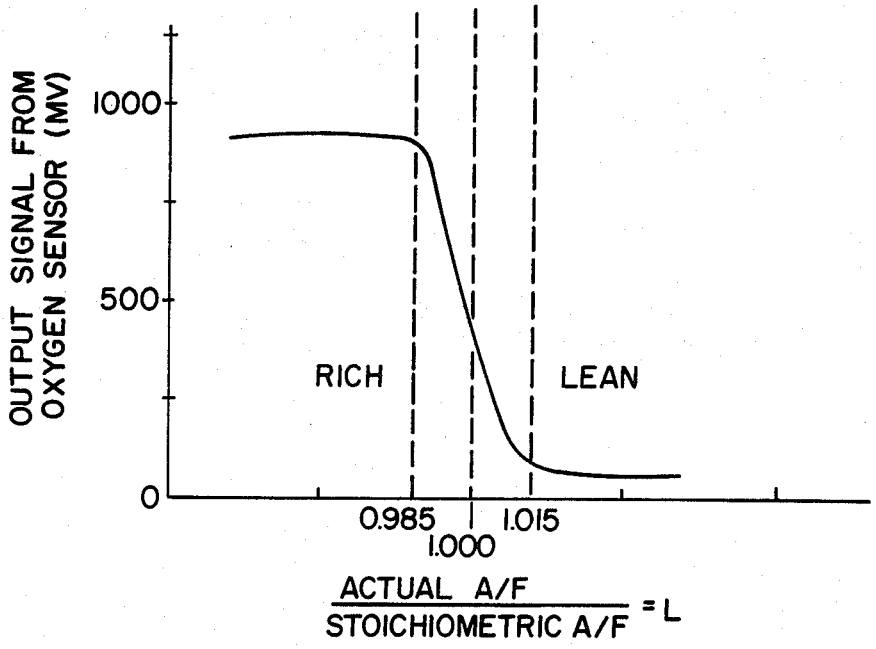
FIG. 1 is a graph showing on the vertical axis the output signal in millivolts of an oxygen sensor positioned in the exhaust gas emerging from a combustion chamber, plotted against the air-to-fuel specific ratio (as defined below) of the combustible mixture fed to the chamber.

As above stated, one of the objects of the present invention is to enable the control of the air-to-fuel (sometimes below abbreviated as "A/F") ratio at a selected setting outside the range of responsiveness of a state of the art oxygen or other gas component sensor. The response range of such a sensor is illustrated by the graph of FIG. 1, in which there is plotted in millivolts on the vertical axis the output signal generated by a conventional zirconia-type oxygen sensor positioned in the untreated exhaust gas emanating from an internal combustion engine. On the horizontal axis there is plotted the ratio of the actual A/F ratio to the stoichiometric A/F ratio, which will be hereinbelow referred to as the air-to-fuel "specific ratio" and is represented by the symbol "L" in the drawings and specification. Reference to the specific ratio is a conventional useage because it is useful in avoiding confusion in making comparisons between different operations. For example, an A/F ratio of 14.65 (weight of air to weight of fuel) is the stoichiometric ratio corresponding to the combustion of a hydrocarbon fuel with an average formula $CH_{1.88}$. Fuels with different carbon/hydrogen ratios will require different A/F ratios to produce a stoichiometric mixture. The symbol L is thus used to represent the relationship of a particular or actual A/F ratio to the stoichiometric A/F ratio. The actual A/F ratio is divided by the stoichiometric A/F ratio so that in this system $L=1$ is a stoichiometric mixture, $L>1$ is a fuel-lean mixture and $L<1$ is a fuel-rich mixture. For example, at an actual A/F ratio of 14.5 for a $CH_{1.88}$ hydrocarbon fuel, $L=14.5/14.65=0.9898$ is a fuel-rich mixture.

Referring now to FIG. 1, the vertical axis at $L=1.0$ represents stoichiometric operation of an internal combustion engine and the graph shows that under these conditions the output of a zirconia type sensor in the exhaust gas stream will have a signal strength of about 400 millivolts. As shown by the graph of FIG. 1, the curve of the output signal from the sensor has a steep slope in a relatively narrow range on either side of the stoichiometric A/F ratio ranging from about 900 millivolts at $L=0.985$ to somewhat less than 100 millivolts at $L=1.015$. The shape of the curve varies somewhat with variations in engine operation. However, in general, the curve may have a very small slope outside the $L=0.985$ to 1.015 range, and it is readily apparent from the curve that it becomes difficult or impossible to obtain a reliable reading for values of L outside the range.

Figure 2:
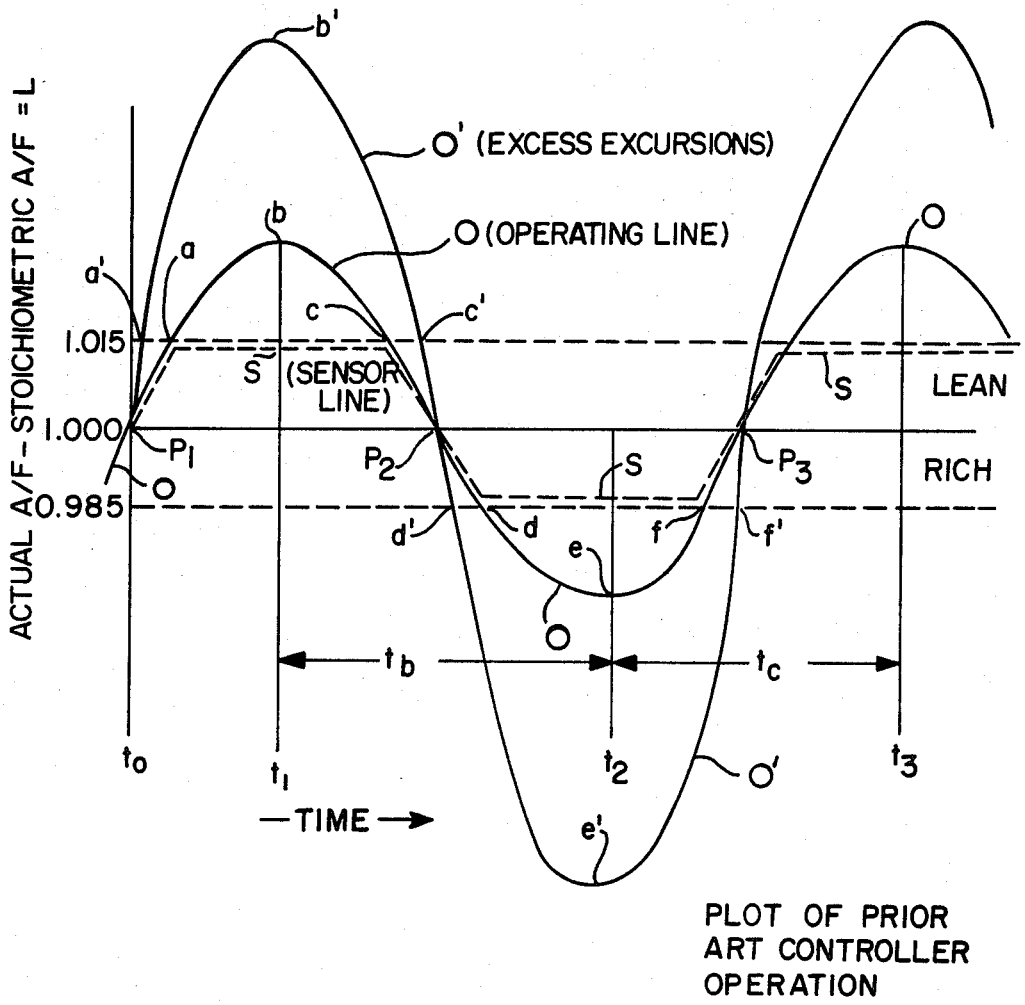
FIG. 2 is a graph showing on the vertical axis the air-to-fuel specific ratio of a combustible mixture feed to a combustion chamber, plotted against time, illustrating the operation of a prior art control system.

Conventional control systems of the closed loop type are intended primarily for catalytic exhaust gas purification using three way conversion catalyst which, as mentioned above, requires operation at stoichiometric for most effective purification of the exhaust gases. This is accomplished by manipulating the A/F ratio to rapidly oscillate about stoichiometric. Such operation requires a precise and sensitive carburetor or fuel injection system with a control logic specific for the characteristics of the particular engine to which the system is applied. Accordingly, such a control system is rather expensive. Such prior art operation is schematically illustrated in FIG. 2, in which the specific ratio L is plotted on the vertical axis against time on the horizontal axis. The horizontal axis $L=1.0$ represents stoichiometric operation, with operation above the $L=1.0$ axis being in the lean region, and operation below the $L=1.0$ axis being in the rich region. The sensor responsiveness range is indicated by the dashed horizontal lines at, respectively, $L=0.985$ and 1.015. The prior art control system is adapted to generate a signal when the A/F ratio crosses stoichiometric at $L=1.0$. Because the responsive range is so narrow it is not feasible to maintain conditions within the very narrow band between $L=0.985$ and 1.015. Therefore, it is attempted to maintain oscillating rich-lean conditions along operating line O. The three way conversion catalyst is capable of tolerating limited excursions into the rich and lean regions, which average out to approximately stoichiometric operation. Thus, it is desired that lean region operation outside a very narrow band around stoichiometric, such as that bounded by the area abca of FIG. 2, will be compensated for by subsequent rich area operation in the area bounded by defd. Since the sensor response range is limited, the conditions as sensed by the sensor are represented by the dashed sensor line S. The system operates as follows. Assume that the carburetor or other air-fuel proportioning device is moving in the lean direction along the operating line O and crosses $L=1.0$ at time $t_0$. At points $P_1$, $P_2$ and $P_3$, the sensor senses a change between rich and lean: Starting at time $t_1$, the system will initiate a change of the carburetor or other air-fuel proportioning device to move away from lean towards the rich direction for a selected interval of time $t_b$ at a selected rate or rates of movement. At time $t_2$ the direction of the carburetor or other fuel proportioning device is reversed, to move in the rich direction for a time interval $t_c$, at a selected rate or rates of movement. At the end of the time interval $t_c$, at time $t_3$, the carburetor or other device is moved back towards the lean condition to repeat the cycle.

This type of control cycle is discussed in SAE (Society of Automotive Engineers) Paper "Development of the Volvo Lambda-Sond System" by Grune T. Engh and Stephen Wallman, Paper 7 0295, presented at the International Automotive Engineering Congress and Exposition, Cobo Hall, Detroit Feb. 28-Mar. 4, 1977. See FIG. 23 of the paper. With this system, the extent of the respective excursions into the rich and lean regions can not be determined by the sensor and conditions may be such as to cause an excursion, for example, along path a'b'c' into the rich region or along d'e'f' into the lean region. Of course, a rich excursion may not necessarily be compensated for by a corresponding lean excursion and extreme excursions may well exceed the excursion tolerance of the three way conversion catalyst. As a result, noxious components of the exhaust gas will not be as effectively treated.

The rapid oscillating system is nonetheless useful for three way conversion catalysts on engines burning liquid hydrocarbon fuel, i.e., gasoline. However, the present invention not only permits better control and operation at a selected A/F ratio which may be significantly rich or lean of stoichiometric, but is readily adapted for use with a gaseous fuel device, which lacks the quick fuel-flow response time provided by a liquid fuel device. If the prior art system of FIG. 2 were used with a gaseous fuel, larger excursions along a'b'c' and d'e'f' of operating line O' would result and detract from efficient catalytic treatment. In contrast to the oscillating control system, the present invention also permits substantial periods of "open loop" operation during which the control system is not actively adjusting the A/F ratio.

Figure 3:
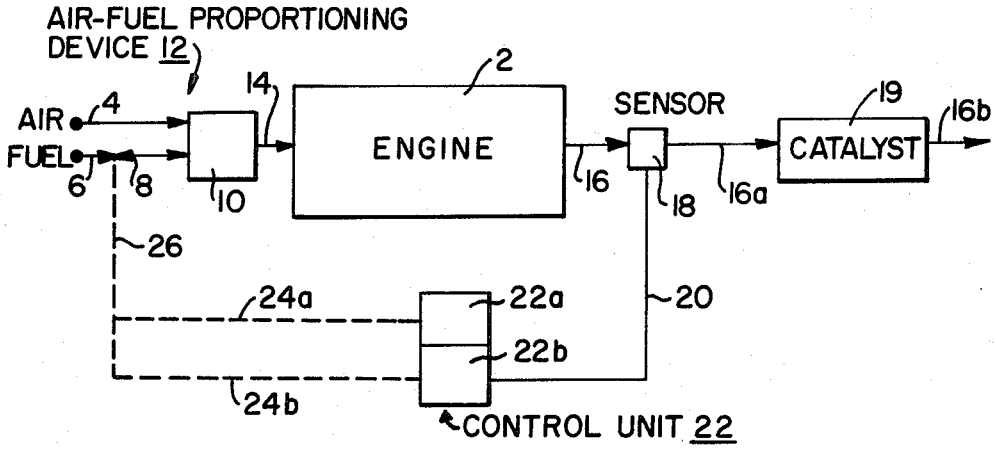
FIG. 3 is a schematic electrical and mechanical block diagram illustrating one embodiment of the present invention comprising an internal combustion engine equipped with an air-to-fuel ratio control system and utilizing a catalyst to treat the exhaust from the engine.

Referring now to FIG. 3, there is shown a schematic rendition of one embodiment of the present invention in which an internal combustion engine 2, which may be an Otto Cycle natural gas-fueled internal combustion engine, is supplied with air and natural gas as a fuel through, respectively, lines 4 and 6. A fuel control valve 8 is positioned in line 6. Lines 4 and 6 form part of a carburetor 10, which comprises an air-fuel proportioning device generally indicated at 12, which feeds a combustible air-fuel mixture at a selected A/F ratio via line 14 into engine 2. Engine 2 has an exhaust gas line 16, **16*a*, 16*b* through which the combustion exhaust gases pass. A sensor 18, of the type having a limited range of response as illustrated in the graph of FIG. 1, is interposed in the exhaust line between segments 16 and 16*a*. A catalyst 19 is in the exhaust line, to purify the gases before they are discharged via line segment 16b**. Any suitable catalyst may be employed.

The output signal of sensor 18 is transmitted via electrical connector 20 to a control unit 22 which comprises a reset means 22a and a positioning means 22b. The electrical output from reset means 22a is transmitted via electrical connector 24a, 26 to operate fuel control valve 8. The electrical output from positioning means 22b is also transmitted, via electrical connector 24b, 26, to operate fuel control valve 8.

In the embodiment illustrated in FIG. 3, fuel control valve 8 serves as the adjusting means of an air-fuel ratio metering device by adjusting the proportion of fuel relative to air which is fed into carburetor 10. Obviously, any suitable air-fuel ratio proportioning device such as a carburetor or fuel injection system may be employed, and an appropriate drive mechanism may be connected to operate the adjustment screws on a carburetor or the controls of a fuel injection device to adjust the A/F ratios as taught by the invention. Before describing the operation of the embodiment illustrated in FIG. 3, some additional details of one form of construction in accordance with the invention will be described with reference to the schematic diagram of FIG. 4, in which an internal combustion engine 2' is supplied with a combustible air-fuel mixture via line 14' and exhaust gases are discharged through exhaust 16', 16'' and 16a', passed through a catalyst 19', and finally discharged via line segment 16b'. An oxygen sensor 18' has its probe end disposed within exhaust line 16' and in response to the oxygen level sensed in the exhaust gas generates an output signal $E_o$ which is transmitted through a suitable electrical connector 21 to a comparator 28. A reference signal $E_r$ is also fed through a suitable electrical 25 comparator from a reference source 30 to comparator 28. In the case illustrated, reference source 30 may be adjusted so that reference signal $E_r$ has a value of 400 millivolts, corresponding to stoichiometric operation for the case illustrated in FIG. 1. Comparator 28 is connected by an electrical connector 32 to timer B which is in turn connected via electrical connector 34 to a drive rich motor 36 which is operatively connected via connector means 38 to air-fuel ratio metering device 42. A reset connector 44 connects the output of timer B to a timer A which in turn is connected via electrical connector 46 to a drive lean motor 48. Drive lean motor 48 is operatively connected via connector means 50 to air-fuel ratio metering device 42.

In operation, assume that internal combustion engine 2' is running rich. This would be the normal, desired condition, for example, for a natural gas fueled internal combustion engine. Timer A is running and is set for a preselected interval, say, five minutes, and when the five minute interval is reached, timer A emits a signal through electrical connector 46 which operates drive lean motor 48 to move air-fuel ratio control mechanism 42 to a lean condition. This changes the exhaust gas condition and oxygen sensor 18' generates its output signal $E_o$ as the condition of the exhaust gas changes to provide an oxygen level which falls within the responsive range of sensor 18'. When the transmitted output signal $E_o$ becomes less than the 400 millivolt reference signal $E_r$, which will occur when L crosses the 1.0 line moving in the lean direction as shown in FIG. 1, comparator 28 generates a signal $E_1$ which is transmitted through electrical connector 32 and triggers an output signal $E_2$ which operates the drive motor 36 to drive the air-fuel ratio proportioning device 42 towards the rich direction for a preselected interval of time, say, for 1 second. Alternatively, instead of a timed drive, means to move the adjustment means of such a proportioning device, eg., the set screw of a carburetor, a selected distance as sensed by a location or displacement sensor, may be utilized. Signal $E_2$ is also transmitted through connector 44 to timer A to reset timer A to zero in order to re-start the five minute interval of timer A. When the five minute interval measured by timer A has run, the sequence starts over again. Thus, it is seen by periodically, in this case every five minutes, adjusting the air-fuel ratio control mechanism 42 to change the air-fuel ratio towards stoichiometric (in this case, towards a lean condition) a signal is generated when a selected point (in this case, stoichiometric) is reached which causes the air-fuel ratio metering device to be operated a selected amount away from the selected point, in this case, towards the rich condition. Thus, the temporarily and periodically induced stoichiometric condition serves as a reference point from which, by providing an appropriate drive interval of drive rich motor 36, a preselected adjustment can be made to any desired range within the rich area of operation. Obviously, reference signal $E_r$ could conveniently be set at any value between about 100 and 900 millivolts to establish a reference signal anywhere within the responsive range of the sensor 18'. In this manner, the sensor 18' may be utilized to control the air-fuel ratio set for any value, rich or lean, even though the value is outside the responsiveness range of the sensor 18'.

With reference to FIG. 3, it is seen that the output signal $E_o$ will be transmitted from sensor 18 via line 20 to positioning means 22b and when it exceeds the preselected reference signal positioning means 22b (corresponding to drive motor 36 and its associated initiators) will adjust fuel control valve 8 by opening it a preselected amount to shift the A/F ratio towards the desired, preselected rich condition. Reset means 22a, corresponding to drive mean motor 48 and its associated timer A, will periodically at a selected interval move fuel valve 8 towards the closing direction to drive the A/F ratio towards the lean direction. An appropriate setting can be made of reference 30 (FIG. 3) to cause comparator 28 to initiate the drive rich sequence from a selected reference point to cause positioning means 22b to operate fuel control valve 8 a preselected amount in the opening direction, thereby re-establishing the desired A/F ratio.

Figure 4:
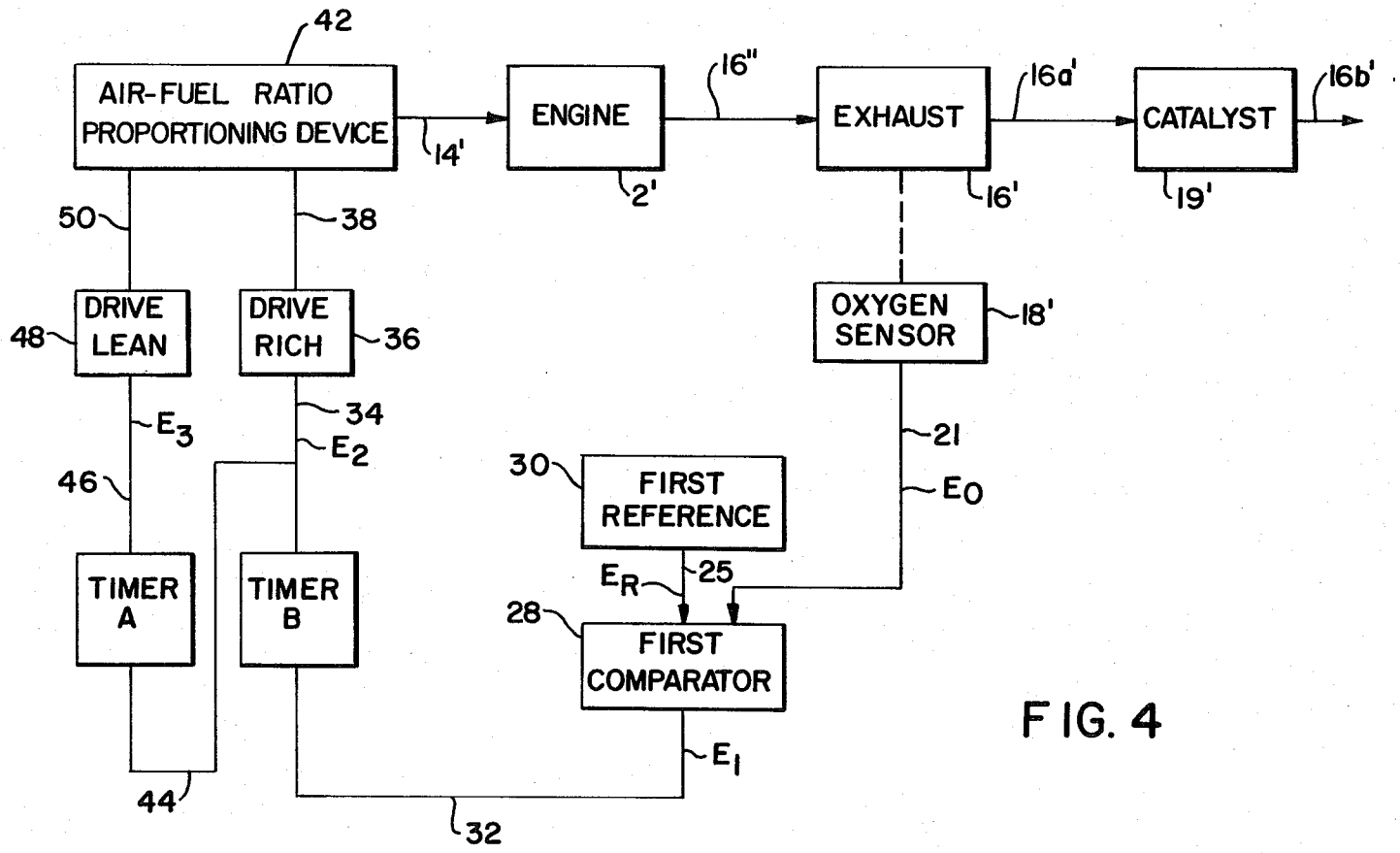
FIG. 4 is a schematic electrical and mechanical block diagram showing in somewhat greater detail the electrical circuitry portion of the embodiment illustrated in FIG. 3.
Figure 5:
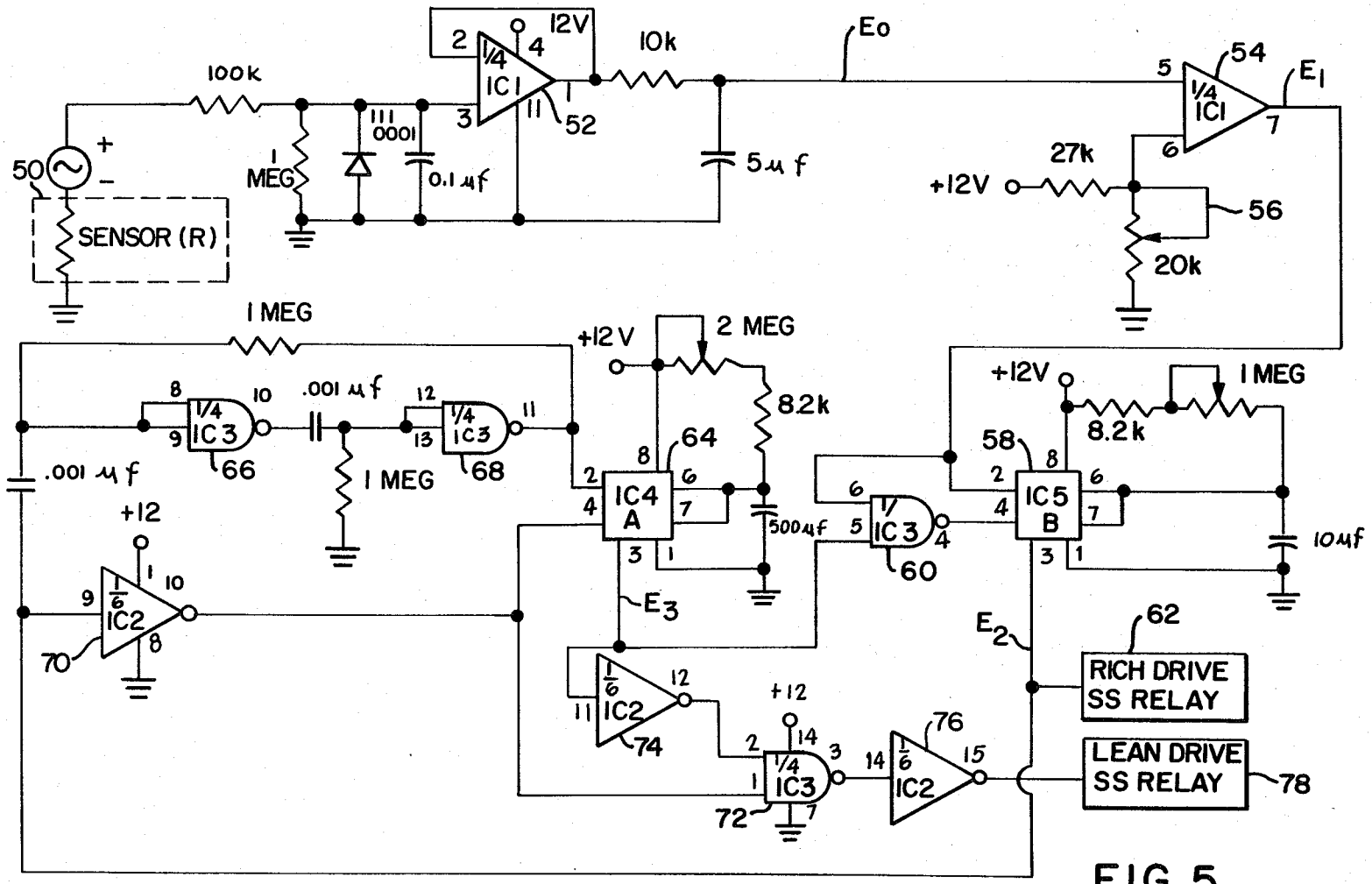
FIG. 5 is a schematic electrical diagram of one embodiment of electronic circuitry useable in the present invention.

The control unit portion (see FIG. 3) of a system generally conforming to that broadly illustrated in FIG. 4 is illustrated in some detail in FIG. 5. The signal generated from oxygen sensor 50 and passed through a buffer amplifier 52 is output signal $E_o$, which has a value that is a function of the amount of oxygen in the exhaust gas contacted by sensor 50. The strength of signal $E_o$ is inversely proportional to the oxygen content of the exhaust gases and is applied as one of two inputs to a comparator circuit generally indicated at 54. A reference circuit 56 applies a reference signal of, for example, 400 millivolts as the second input to comparator circuit 54. Obviously, any desired reference signal may be selected. Given the constraints of the conventional oxygen sensor, as described above, a reference signal between about 100 and 900 millivolts would be selected for the reference signal. A different sensor, say a carbon dioxide sensor, which might have a different responsiveness range would require the selection of an appropriate reference signal within its response range.

When the output signal $E_o$ falls below the setting, say 400 millivolts, of the strength of the signal provided by reference circuit 56, as would occur if the engine were to run lean or if the oxygen sensor 50 were to fail, comparator 54 provides an output signal $E_1$ transition from plus 12 to 0 volts. The signal $E_1$ is applied to timer 58, a 0.1 second to 10 second adjustable timer, and to nand gate 60 to start a timing cycle of timer 58. The output signal $E_2$ of timer 58, a plus 12 volt signal, is applied to drive rich relay 62 and to timer 64 through the monostable multivibrator comprised of nand gates 66 and 68 and to timer 64, through inverter 70. The output signal $E_2$, acting through rich drive relay 62, drives the air-fuel ratio proportioning device (not shown in FIG. 4 but corresponding to 42 in FIG. 3) towards a rich condition until output signal $E_1$ is 12 volts and timer 58 times out.

When timer 58 times out, and output signal $E_o$ sensor 50 is greater than 400 millivolts, signifying a rich A-F ratio engine running condition, signal $E_2$ switches from 12 volts to 0 volts. This transition of signal $E_2$ starts timer 64 through nand gates 66 and 68, connected as a monostable multivibrator, and inverter 70. When signal $E_2$ attains zero, it also serves to turn off rich drive relay 62. Timer 64 is adjustable for a 1 to 10 minute time delay and when it is timing, and oxygen sensor 50 output signal $E_o$ indicates a rich engine operating condition, the air-fuel ratio metering device is not being adjusted by the system, i.e., is inactive.

After a set time, timer 64 times out and signal $E_3$ changes from plus 12 volts to 0 volts and passing through nand gates 60, 72 and inverters 74, 76, energizes lean drive relay 78 and prepares timer 58 to start timing. When sensor 50 senses lean conditions from the oxygen level in the exhaust gas, its output signal $E_o$ switches from plus 12 volts to 0 volts and the cycle as described above repeats.

In the specific embodiment illustrated in FIG. 5, buffer amplifier 52 and comparator 54 pin number identifications are those of National's quad operational amplifier LM-324N. Inverters 70, 74 and 76 are RCA's Hex Buffer CD-4049AE, nand gates 66, 68, 60 and 72 are RCA's Quad Nand Gate CD-4011AE, and the timers 64 and 58 are RCA's Timers CA-888G.

Figure 6:
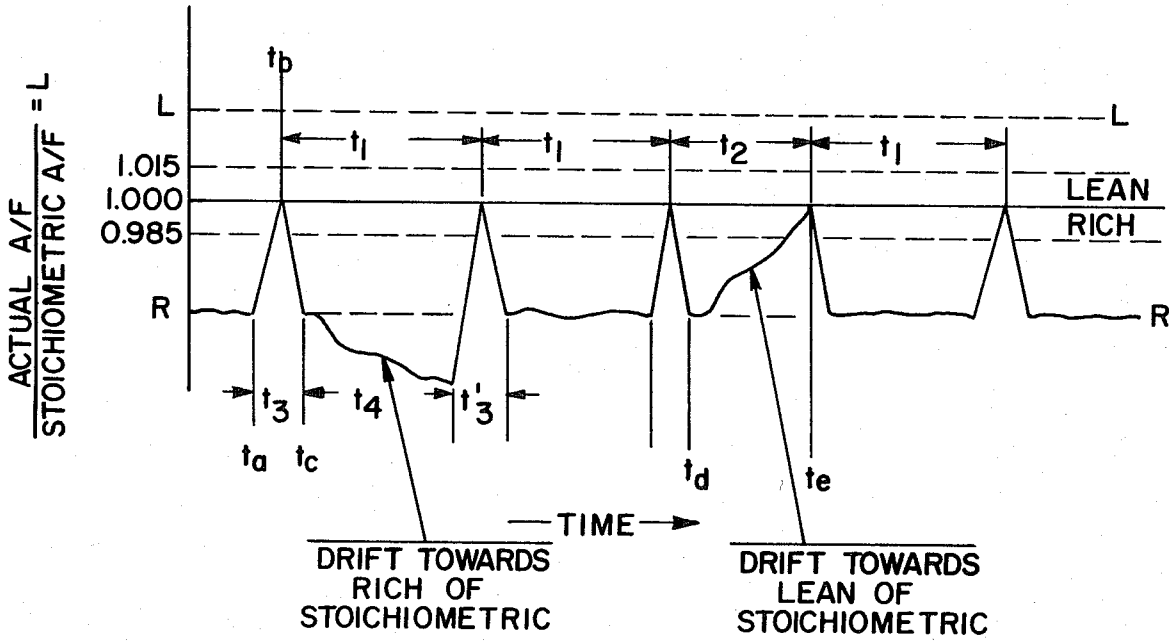
FIG. 6 is a graph showing on the vertical axis the air-to-fuel specific ratio of a combustible mixture fed to a combustion chamber, plotted against time, illustrating the operation of one embodiment of a control system of the present invention.

The operation of the invention may be better understood with reference to FIG. 6, which plots on the vertical axis the specific ratio L, against time on the horizontal axis, as in the graph of FIG. 2. Thus, the horizontal axis is at L=1.0, with operation above this axis line being in the lean region and operation below it in the rich region. The sensor responsiveness range is indicated by the dashed lines at, respectively, L=0.985 and 1.015. Assume that it is desired to operate the engine at the rich condition outside the sensor response range, which preselected rich condition is indicated by the dashed line horizontal axis R-R. Starting at the vertical axis it is seen that the engine is operating at the desired A/F ratio. At the time $t_a$ timer A has reached the end of its timing cycle and operates the air-fuel ratio control mechanism towards lean. At time $t_b$ stoichiometric conditions have been attained and this actuates timer B to actuate its drive motor and operate the air-fuel ratio control mechanism for a given time interval which is calibrated for the particular engine involved, so that at time $t_c$ the desired rich A/F ratio along axis R-R has been attained. Immediately after time $t_c$, as indicated by the graph of FIG. 6, the stoichiometry of the air-fuel mixture may change for one or more of a variety of reasons, such as a change in load, a change in fuel composition or any other unexpected or variable condition (such as pressure or atmosphere temperature change, or exhaust back pressure change, etc.). This causes a drift deeper into the rich range because the actual A/F ratio and/or the stoichiometric ratio is changing. The present invention permits tracking of charges in stiochiometric ratio. However, at time $t_4$, timer A has completed its timing sequence and so actuates drive an motor 48 to adjust the control mechanism 42 towards the lean condition, which it continues to do so until the stoichiometric condition is sensed by the sensor which triggers the sequence as above-described to operate the air-fuel ratio metering device a preselected amount back towards the rich condition along the axis R-R. The next time sequence $t_1$ shows steady state operation of the engine with close adherence to the selected A/F ratio. However, after the next adjustment cycle ending at $t_d$, due to unforeseen or variable conditions, the engine starts moving in the lean direction, so much so that at $t_e$ it attains stoichiometric conditions. This self-attained stoichiometric condition will trigger the signal $E_1$ in the same manner as if the stoichiometric condition were imposed by operation of the ratio control mechanism towards lean, and initiate the sequence of backing off the valve towards the rich direction a preselected amount until operation along the A/F axis R-R is attained. FIG. 5 shows that the sequence after $t_e$ resumes normal operation. It will be noted that the normal time interval $t_1$ between operation at the reference points is foreshortened in the time interval $t_2$ because the engine attained the lean condition before it would have been imposed by timer A and its associated drive lean motor 48. At time $t_e$ the sequence also resets timer A so that the next following sequence occurs at the normal preselected time interval $t_1$.

In actual operaton, time interval $t_1$ may conveniently be selected to be about 1–10 minutes, preferably about 3–5 minutes and the time interval of one half $t_3$, during which the ratio control mechanism is driven into the rich range, may conveniently be selected from about 0.1 to 5 seconds. Thus, the cumulative time the air-to-fuel ratio is set at the second (imposed by the positioning means) value is about at least twelve times greater than the cumulative time it is set at the first (reset means imposed) value. Obviously, any time periods suitable for the particular device involved may be selected. By opening a given valve or adjusting screw or other device having a set speed of travel for a set interval in time, the amount of opening (or closing) time necessary to select a desired A/F ratio may readily be determined in each case. Alternatively, displacement or location sensors may be utilized to control the amount of movement. The respective time intervals $t_1$ and $t_3$ are not necessarily drawn to scale in FIG. 6, and in fact, the time intervals $t_1$ are usually relatively much larger than the time intervals $t_3$ illustrated in FIG. 6. Thus, if the most efficient mode of operation for a given engine or other device is along the axis R-R, it will be seen that the cumulative time of excursions away from R-R in order to find the stoichiometric reference point in return from it is quite small relative to the cumulative time of operation along the desired axis R-R. In fact, practical experience with natural gas fired engines has shown that the periodic setting of a stoichiometric or lean reference point does not appreciably affect the overall operation of the engine. Further, utilization of the invention appears to provide a practical fuel savings. This is because natural gas engines often operate for extended periods of time in remote areas, such as pipeline pumping stations, and are not continuously attended. Thus, if the engine requires a certain rich A/F ratio to continue operating, such an engine, operating without benefit of the present invention, will be set by the operator to a condition which is somewhat richer than the ideal A/F ratio. This is done to allow a safety margin in case transient conditions, load changes or the like cause the engine to drift towards the lean condition. Thus, the engine is normally operating richer than is necessary, with concomitant excess fuel consumption. With the present invention, the engine may be set to operate for the vast majority of its time along precisely the ideal A/F ratio with the assurance that the invention will maintain the ratio.

Although the foregoing description has been made specifically with reference to operation at a rich A/F, it obviously applies equally to operation at a lean A/F. For example, operation could be set along the A/F ratio identified in FIG. 5 by horizontal axis L-L. This could be attained by simply making suitable modifications to the diagram of FIG. 4 so that air-fuel ratio control mechanism 42 would periodically be operated in the rich direction from a setting along axis L-L towards stoichiometric, to find a reference point and then could be reset for a selected drive interval to a lean setting. Obviously, means such as an adjustable timer may be provided to permit selection of the duration of the drive interval.

Control of the A/F ratio is not only important to maintain engine efficiency and smooth running, but is also important to enhance the efficiency of a catalyst which may be utilized in the exhaust gas line to purify the exhaust gas. Such catalysts, which may be used in single or multiple stages, are employed to reduce nitrogen oxides to nitrogen and/or to oxidize unburnt hydrocarbons and carbon monoxide to water and carbon dioxide. Thus, the selection of a specific A/F ratio will be carried in a manner known to those skilled in the art to accommodate not only engine efficiency but catalyst efficiency. Oxidation catalysts such as those shown in U.S. Pat. No. 3,565,830, three-way catalysts such as those shown in U.S. Pat. No. 4,157,316 and non-selective $NO_x$ abatement catalysts such as those shown in U.S. Pat. No. 3,118,727 (all these patents being assigned to the assignee of this application) may be used singly or in combination to treat the exhaust gases.

In order to reduce, by use of a non-selective nitrogen oxides reduction process, the nitrogen oxides ($NO_x$) in the exhaust of a natural gas fired engine, the engine carburetion system must be adjusted so that the engine runs slightly on the rich side of stoichiometric. There must be a controlled excess of the natural gas fuel over stoichiometric in the fuel-air mixture fed to the engine so that the $NO_x$ in the exhaust can be catalytically reduced.

The exhaust gas emanating from the engine is passed through a catalytic reactor in which the $NO_x$ is reduced, probably according to the following reactions:

$$NO_2 + H_2 \longrightarrow NO + H_2O \quad (1)$$

$$2NO + 2H_2 \longrightarrow N_2 + 2H_2O \quad (2)$$

$$NO_2 + CO \xrightarrow{\text{and/or}} NO + CO_2 \quad (3)$$

-continued $$2NO + 2CO \longrightarrow N_2 + 2CO_2 \quad (4)$$

The control system of the present invention is particularly useful in controlling the air-to-fuel ratio at a rich level selected to enhance operation of the catalytic abater. Such a system has, as described above, other advantages, such as fuel economy, because an A/F ratio which will optimize $NO_x$ abatement and engine performance can be more closely maintained.

EXAMPLE

The following engine is supplied with an A/F ratio control system in accordance with the present invention:

| | | |
|---|---|---|
| Engine: | Waukesha L7042GU | |
| HP: | Nominal; 1000 Hp at 1200 RPM. Operating: 580 Hp at 750 RPM. | |
| Exhaust Pipe Connection: | 8" or 10" | |
| Fuel Composition: | Methane | 89.37% |
| | Ethane | 6.66% |
| | Propane | 1.48% |
| | Butane | .26% |
| | Pentane | .04% |
| | Hexane | .03% |
| | Carbon Dioxide | .99% |
| | Nitrogen | 1.15% |
| | Oxygen | .01% |
| Exhaust Gas Flowrate: | 1298 SCFM at 60° F. ambient temperature, at 900 RPM engine operation | |
| Exhaust Gas Temperature: | 957° F. | |
| Available Pressure Drop: | 10 inches w.c. | |

The exhaust pipe connection leads to a catalytic convertor having a honeycomb type monolithic catalyst disposed therein. The catalyst is 38 inches in diameter and 3 inches in depth and has 300 rectangular cross-section gas flow passages per square inch. The monolithic honeycomb is comprised of cordierite and has an alumina (predominantly gamma alumina) coating on the surface thereof. There is distended upon the alumina coating catalytic metal comprising platinum, rhodium and ruthenium in a weight ratio of 5:2:1. The total precious metal (platinum, rhodium and ruthenium) loading on the catalyst is between 40 and 50 grams of precious metal per cubic foot catalytic monolithic honeycomb. The catalyst is housed within a convertor 60 inches long to which the exhaust gas line is connected. Within the convertor housing is a distribution plate to aid in distributing the exhaust gas flow across substantially the entire face of the catalyst. The monolithic honeycomb catalyst is substantially disc shaped with its gas flow passages extending parallel to each other from the substantially circular inlet face to the substantially circular outlet face thereof.

The following table shows the exhaust gas analysis honeycomb as follows.

Analysis A—Raw exhaust gas upstream of the catalyst.

Analysis B—Treated exhaust gas downstream of the catalyst.

Analysis C—Raw exhaust gas upstream of the catalyst with the engine operated at a selected A/F ratio maintained by a control system in accordance with the present invention.

Analysis D—Treated exhuast gas downstream of the catalyst with A/F ratio maintained by the same control system as in Analysis C.

| Volume Percent (% vol) or Volume Parts Per Million (ppmv) | | | | |
|---|---|---|---|---|
| Analysis | Spindt* A/F Ratio | NOx | CO | Hydrocarbons |
| A | 15.0 | 660 ppmv | 3.0% vol | 1750 ppmv |
| B | 15.0 | 75 ppmv (88.6% conversion) | 2.7% vol 10% conversion) | 1250 ppmv (28% conversion) |
| C | 16.5 | 2790 ppmv | 8706 ppmv | 1100 ppmv |
| D | 16.5 | 183 ppmv (93% conversion) | 870 ppmv (90% conversion) | 650 ppmv (41% conversion) |

*Spindt A/F ratio is an air-fuel ratio calculated in accordance with the method in the article "Air/Fuel Ratios From Exhaust Gas Analysis" by R. S. Spindt, SAE Paper 650507. This publication is incorporated by reference herein.

As shown by the above example, the control system of the present invention permits maintenance of a selected air-to-fuel ratio even at values substantially outside the response range of a conventional oxygen sensor, thereby enhancing the operation of an exhaust gas purification catalyst as well as attaining good engine efficiency. Note in Analysis C, for example, that the unburned hydrocarbons are substantially reduced as compared to operation at the lower air-to-fuel ratio and that higher conversion efficiency of the noxious components is obtained at the maintained higher air-to-fuel ratio. Successful operation has also been attained with an otherwise identica catalyst containing platinum and rhodium in a weight ratio of 4:1 as the catalytic metals.

In addition to internal combustion engines, the present invention is equally applicable to controlling the air-fuel ratio fed to catalytic combustors. Such catalytic combustors employ a catalyst, such as that shown in U.S. Pat. No. 3,928,961, assigned to the assignee of the present application, to enable combustion of a fuel at a lower temperature than would occur with uncatalyzed combustion. Such operation has the benefit of avoiding or minimizing production of nitrogen oxides, which is an increasingly important consideration in maintaining air polluting standards. Such combustors have numerous uses as prime heat sources as described, for example, in U.S. Pat. No. 3,928,961, assigned to the assignee of the present application.

While the invention has been described with respect to specific preferred embodiments, it will be apparent to one skilled in the art that numerous variations may be made to the embodiments without departing from the spirit and scope of the invention. For example, the periodic intervals between establishing the reference points in the vicinity of stoichiometric operation need not be, although they preferably are, regular i.e., of equal duration. Reference to "a combustion chamber" in the specification and claims is intended to include a plurality of discrete chambers, such as the individual cylinders of a multi cylinder internal combustion engine.

What is claimed is:

1. The combination of an air-to-fuel ratio control system and a fuel burning mechanism, said fuel burning mechanism having an adjustable air-fuel proportioning device, a combustion chamber and an exhaust conduit serially interconnected in flow communication whereby a selectively proportioned air-fuel mixture may be introduced from said proportioning device into said combustion chamber for combustion therein, and exhaust gases may be withdrawn therefrom through said exhaust conduit;

said air to fuel ratio control system comprising:

sensor means positioned in said exhaust gas conduit and having a range of response to the level of a gaseous component in the exhaust gas to produce a reference signal which varies between certain limits in a predetermined functional relation with said level;

reset means operatively connected to said air-fuel proportioning device for periodically adjusting the air-to-fuel ratio by an amount sufficient to obtain a first value of said air-to-fuel ratio which first value produces a certain level of said component in the exhaust gas as determined by generation of a certain reference signal between said certain limits by said sensor means; and positioning means operatively connected to said proportioning device and responsive to said certain reference signal from said sensor means to adjust the air-to-fuel ratio to a second value which deviates from the first value by a selected amount, so that the air-to-fuel ratio is adjusted to said second value by said positioning means whenever said certain level of gaseous component in the exhaust gas is sensed by said sensor means.

2. The combination of claim 1 wherein said sensor means is an oxygen sensor means responsive to a range of oxygen level in the exhaust gas corresponding to operation about the stoichiometric air-to-fuel ratio and said second value of the air-to-fuel ratio results in a level of oxygen in the exhaust gas lying outside the sensor response range.

3. The combination of claim 1 or claim 2 wherein said positioning means is adjustable to enable selection of the amount of deviation from the first selected value which is imposed on said air-fuel metering means by said positioning means.

4. The combination of claim 3 wherein said fuel burning mechanism comprises a catalytic combustor.

5. The combination of claim 3 wherein said fuel burning mechanism comprises an internal combustion engine.

6. The combination of claim 5 further including an exhaust gas purification catalyst positioned in said exhaust conduit downstream of said sensor means.

7. The combination of claim 5 wherein said internal combustion engine is a natural gas fueled engine and said positioning means is configured to adjust the air-to-fuel ratio to a second value which is rich of stoichiometric.

8. The combination of claim 3 wherein said sensor means is an oxygen sensor means comprising zirconia whose responsiveness range embraces an oxygen level in the exhaust gas corresponding to operation about the stoichiometric air-to-fuel ratio, and said positioning means is configured to adjust the air-to-fuel ratio to a second value which is such as to result in an oxygen level in the exhaust gas which is outside the responsiveness range of said sensor.

9. The combination of claim 8 wherein said positioning means is configured to adjust the air-to-fuel ratio to rich of stoichiometric.

10. The combination of claim 8 wherein said positioning means is configured to adjust the air-to-fuel ratio to lean of stoichiometric.

11. The combination of claim 3 wherein said air fuel metering device includes adjustment means to change the air-to-fuel ratio setting of said metering device, said reset means comprises a first device means actuated by a resettable first timing means and operatively associated with said adjustment means to periodically drive said adjustment means to change the air-to-fuel setting of said metering device, and means to periodically reset said first timing means, and said positioning means comprises a second drive means activated by a second timing means and operatively associated with said adjustment means to change the air-to-fuel setting of said metering device in a direction opposite to that of said reset means.

12. The combination of claim 11 further including comparator means having input connectors and an output connector, said input connectors being connected, respectively, to a reference signal source and to said sensor to receive, respectively, a reference signal and the output signal of said sensor, and said output connector being connected to said second timing means to provide an actuating signal thereto upon said sensor output signal attaining a selected level relative to said reference signal.

13. The combination of an air-to-fuel ratio control system and an internal combustion engine having an adjustable air-fuel proportioning device, combustion cylinders and an exhaust gas conduit;

said air-to-fuel ratio control system comprising:

oxygen sensor means positioned in said exhaust gas conduit and having a range of response to the level of oxygen in the exhaust gas to produce a reference signal which varies between certain limits in a predetermined functional relation with said level, said range including stoichiometric operation;

reset means operatively connected to said air-fuel proportioning device for periodically adjusting the air-to-fuel ratio by an amount sufficient to obtain a first value of said air-to-fuel ratio which first value produces a certain level of oxygen in the exhaust gas as determined by generation of a certain reference signal between said certain limits by said sensor means; and positioning means operatively connected to said proportioning device and responsive to said certain reference signal from said sensor means to adjust the air-to-fuel ratio to a second value which deviates from the first value by a selected amount and which results in a level of oxygen in the exhaust gas lying outside said response range, so that the air-to-fuel ratio is adjusted to said second value by said positioning means whenever said certain level of oxygen in the exhaust gas is sensed by said sensor means.

14. The combination of claim 13 wherein said sensor means is a zirconia sensor.

15. The combination of claim 13 or claim 14 wherein said internal combustion engine is a natural gas fueled engine and said positioning means are connected to adjust the air-to-fuel ratio to a second value which is rich of stoichiometric.

16. A method for controlling the air-to-fuel ratio of a fuel burning mechanism by utilizing the sensed level of a component in the exhaust gas, which method permits maintenance of the ratio at values which may result in exhaust gas levels of the component outside the response range of sensor means employed to sense the component level, said combustion mechanism having an adjustable air-fuel proportioning device, a combustion chamber and an exhaust conduit serially interconnected in flow communication whereby a selectively proportioned air-fuel mixture may be introduced from said metering device into said combustion chamber for combustion therein, and exhaust gases may be withdrawn therefrom through said exhaust conduit, the method comprising the steps of:

periodically adjusting the air-to-fuel ratio by an amount sufficient to obtain a first value of said air-to-fuel ratio which first value produces a certain level of said component in the exhaust gas by establishing a certain response range-reference signal level from the sensor means which certain signal level corresponds to said certain level of said component, and detecting the generation of said certain signal level by the sensor means; and adjusting the air-to-fuel ratio in response to said certain signal level in a direction opposite to that employed to attain said first value and in an amount sufficient to attain a second value of the air-to-fuel ratio which deviates from the front value by a selected amount, whereby the air-to-fuel ratio is adjusted to said second value whenever said certain level of said component in the exhaust gas is sensed by the sensor means.

17. The method of claim 16 wherein the second value results in a level of said component in the exhaust gas which is outside the sensor response range.

18. The method of claim 16 or 17 wherein said sensor means is responsive to the level of oxygen in the exhaust gas and said component is oxygen.

19. The method of claim 18 including adjusting the air-to-fuel ratio in the lean direction to attain said first value and adjusting the air-to-fuel ratio in a rich direction to attain said second value, said second value being rich of stoichiometric.

20. The method of claim 18 including adjusting the air-to-fuel ratio in the rich direction to attain said first value and adjusting the air-to-fuel in a lean direction to attain said second value, said second value being lean of stoichiometric.

21. The method of claim 18 wherein the cumulative time the air-to-fuel ratio is set at said second value is greater than the cumulative time it is set at said first value.

22. The method of claim 18 wherein the average time interval the air-to-fuel ratio is set at said first value is from about 0.1 to 5 seconds and the average time interval the air to fuel ratio is set at said second value is from about one to ten minutes.

23. A method for controlling the air-to-fuel ratio of an internal combustion engine by utilizing the sensed level of oxygen in the exhaust gas, which method permits maintenance of the ratio at values which result in exhaust gas levels of oxygen outside the response range of sensor means employed to sense the oxygen level, said response range including stoichiometric operation, said internal combustion engine having and adjustable air-fuel proportioning device, combustion cylinders and an exhaust gas conduit, the method comprising the steps of:

periodically adjusting the air-to-fuel ratio by an amount sufficient to obtain a first value of said air-to-fuel ratio which first value produces a certain level of oxygen in the exhaust gas by establishing a certain response range-reference signal level from the sensor means which certain signal level corresponds to said certain level of said component, and detecting the generation of said certain signal level by the sensor means; and adjusting the air-to-fuel ratio in response to said certain signal level in a direction opposite to that employed to attain said first value and in an amount sufficient to attain a second value of the air-to-fuel ratio which deviates from the first value by a selected amount, and which results in a level of oxygen in the exhaust gas which is outside the sensor means response range, whereby the air-to-fuel ratio is adjusted to said second value whenever said certain level of said component in the exhaust gas is sensed by the sensor means.

24. The method of claim 23 wherein said air-to-fuel ratio is adjusted in the lean direction to said first value and is adjusted in the rich direction to said second value, which second value is rich of stoichiometric.

* * * * *